US005660150A

United States Patent [19]

Andersen et al.

[11] Patent Number: 5,660,150

[45] Date of Patent: Aug. 26, 1997

[54] PISTON AND COMBUSTION ENGINE

[76] Inventors: Anders Andersen, Balskildevej 21, Ask, Solbjerg, Denmark, DK-8355; Peder Otto Brandt, 16/18 Soi Sonkid, Ploenchit Road, Bangkok, Thailand, 10330

[21] Appl. No.: 586,629

[22] Filed: Nov. 1, 1995

Related U.S. Application Data

[63] Continuation of PCT/DK94/00188, May 11, 1994.

[30] Foreign Application Priority Data

May 14, 1993 [DK] Denmark ..... 0569/93

[51] Int. Cl.[6] ..... F02B 75/24

[52] U.S. Cl. ..... 123/45 R; 123/197.1

[58] Field of Search ..... 123/41.37, 45 R, 123/45 A, 197.1

[56] References Cited

U.S. PATENT DOCUMENTS 1,091,854 3/1914 Lundy ..... 123/45 R
2,666,420 1/1954 Teisen .
2,828,906 4/1958 Hardman ..... 123/197.1
3,398,728 8/1968 Hardman .
3,824,970 7/1974 Amery .

FOREIGN PATENT DOCUMENTS 2620910 11/1976 Germany .

*Primary Examiner*—Michael Koczo
*Attorney, Agent, or Firm*—Darby & Darby

[57] ABSTRACT

An internal combustion engine having at least one cylinder and reciprocating means (1) comprising pistons (12) which are slidable in said cylinders, said reciprocating means (1) and pistons (12) having a common axis, a pair of rotors (5,6) mounted on opposite sides of the axis at said reciprocating means (1) to rotate about a common axis perpendicular to the axis at said reciprocating means in opposite directions and in counter phase, connecting means (4) extending from opposite sides of said reciprocating means and engaging one of said rotors (5,6) at a distance from their common axis characterized in that a bearing connection (28,29,35) is provided between at least a portion of the piston, which is in contact with the wall of the cylinder, and the connecting means (4), allowing the piston (12) or at least a portion of the piston to be freely rotatable about its axis. This reduces the wear on the cylinder wall caused by the compression rings near the top dead center of the piston.

9 Claims, 11 Drawing Sheets

PISTON AND COMBUSTION ENGINE

Figure 1:
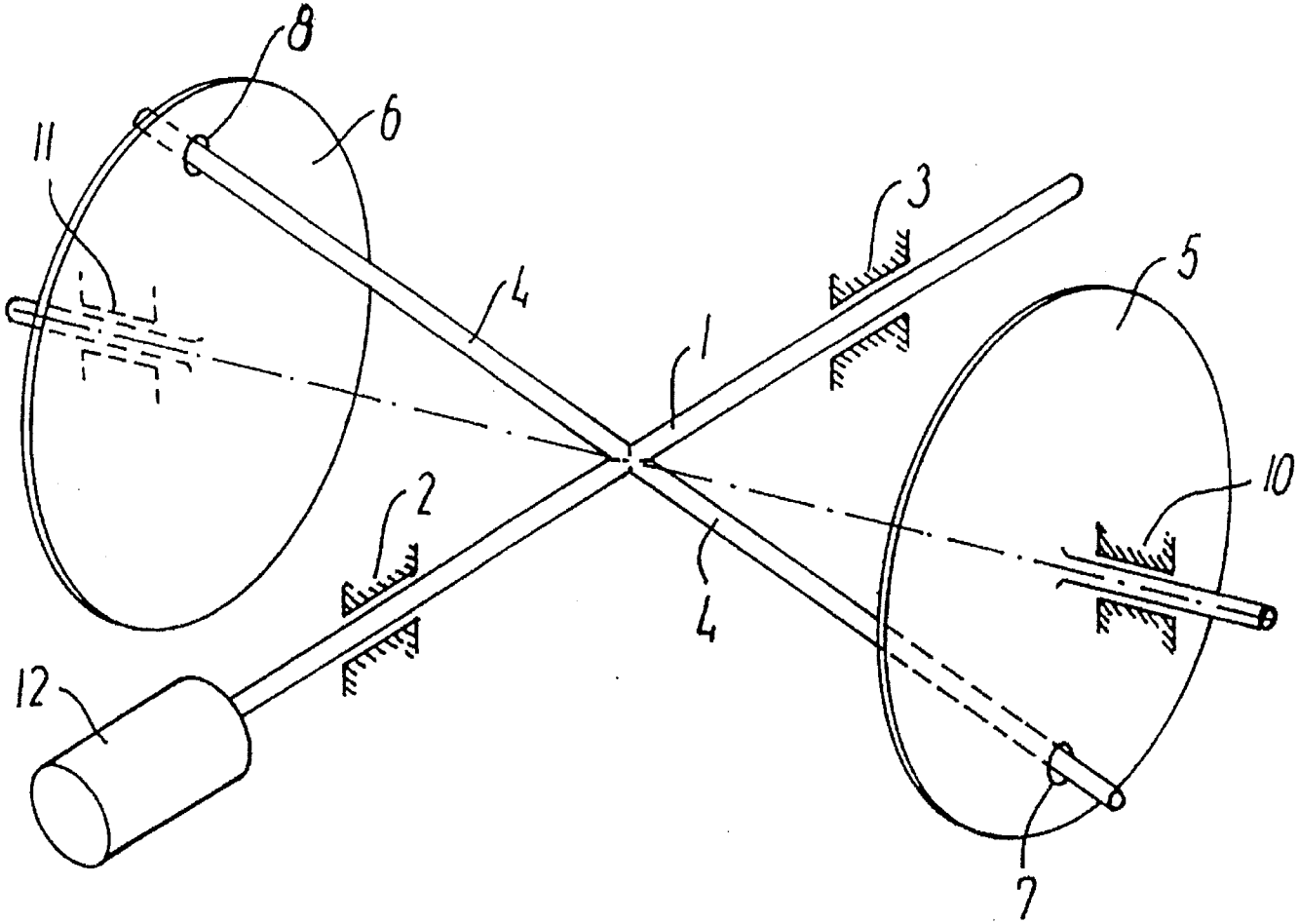

This is a continuation of International Application Ser. No. PCT/DK94/00188, filed May 11, 1994.

The present invention relates to internal combustion engines having at least one or two cylinders and reciprocating means comprising pistons slidable in the cylinders with a common axis, a pair of rotors mounted on opposite sides of the axis of said pistons and reciprocating means, connecting means extending from opposite sides of said reciprocating means, each engaging one of said rotors at a distance from their common axis.

An engine of this type is known from U.S. Pat. No. 2,666,420, which shows a two-stroke engine having the above-mentioned characteristics, thereby providing possibilities for designing engines with one or two cylinders in which vibrations resulting from torque reaction and static and dynamic unbalances are significantly reduced or eliminated.

One effect of the construction according to U.S. Pat. No. 2,666,420 is that the reciprocating piston in the engine is automatically caused to oscillate about its longitudinal axis, which provides suitable timing of the control of the inlet and outlet cylinder ports.

Although this known engine provides an engine with a simple construction working with very little vibration it has not yet become a commercial succes. The reason may be that practical tests show heavy wear on the cylinder wall caused by the compression rings near the top dead-center of the piston.

An effect of the reciprocating and oscillating movement of the piston is thus that the piston near its dead-centers has a very small speed along its axis, but is forced to have a very large angular speed about its axis. Thereby the construction provides good hydrodynamic lubrication between the piston and the cylinder wall when the piston is at a certain distance from its dead-centers, but very bad lubrication near the dead-centers.

Especially at the top dead-center the wear is very high because of the effect that many compression rings are designed to be pressed outwardly from its groove caused by the combustion.

It is therefore an object of the present invention to provide an engine of the above-mention type that reduces the wear of the cylinder wall. This is achieved by the means according to claim 1.

The means according to claim 2 provide the possibility of using a part of the piston for effective control and timing of the scavenging and exhaust processes.

By having the bearing connection between the piston rod and the connecting means, the construction can be used in connection with piston engines based on different working principles.

Separate cooling of the piston top entails that the area of the piston in close contact to the cylinder wall can be reduced without any risk of overheating the piston, the reduced area causing less friction between the piston and the cylinder wall.

When the cooling liquid is supplied through supply lines and return lines in the piston rod, as mentioned in claims 6 and 9, a very effective cooling is provided.

When the piston top is mounted on the piston rod, as claimed in claim 5, the force exerted by the combustion on the piston top is transferred directly to the piston rod, making it possible to reduce the total weight of the piston.

Figure 2:
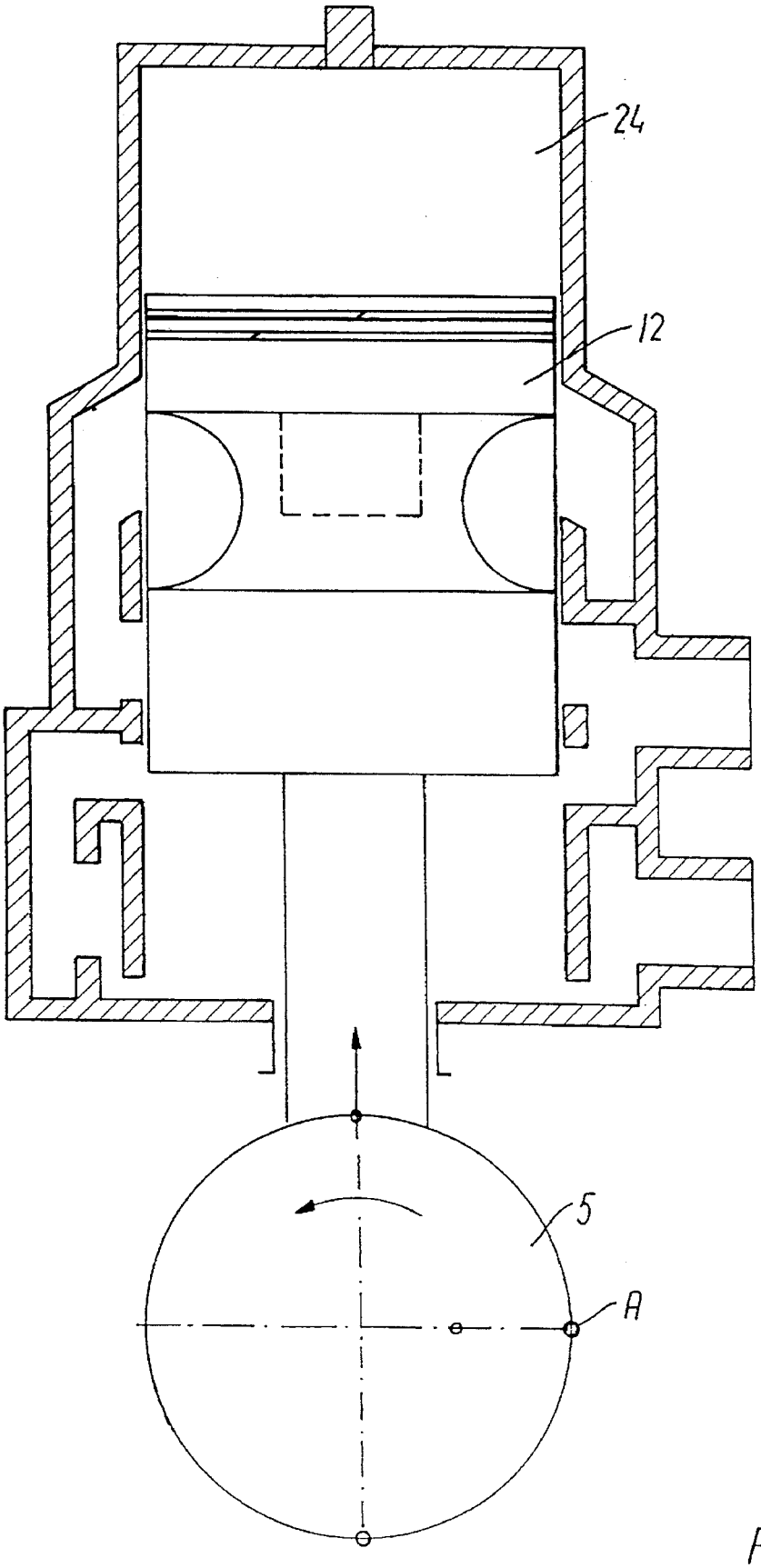
Figure 3:
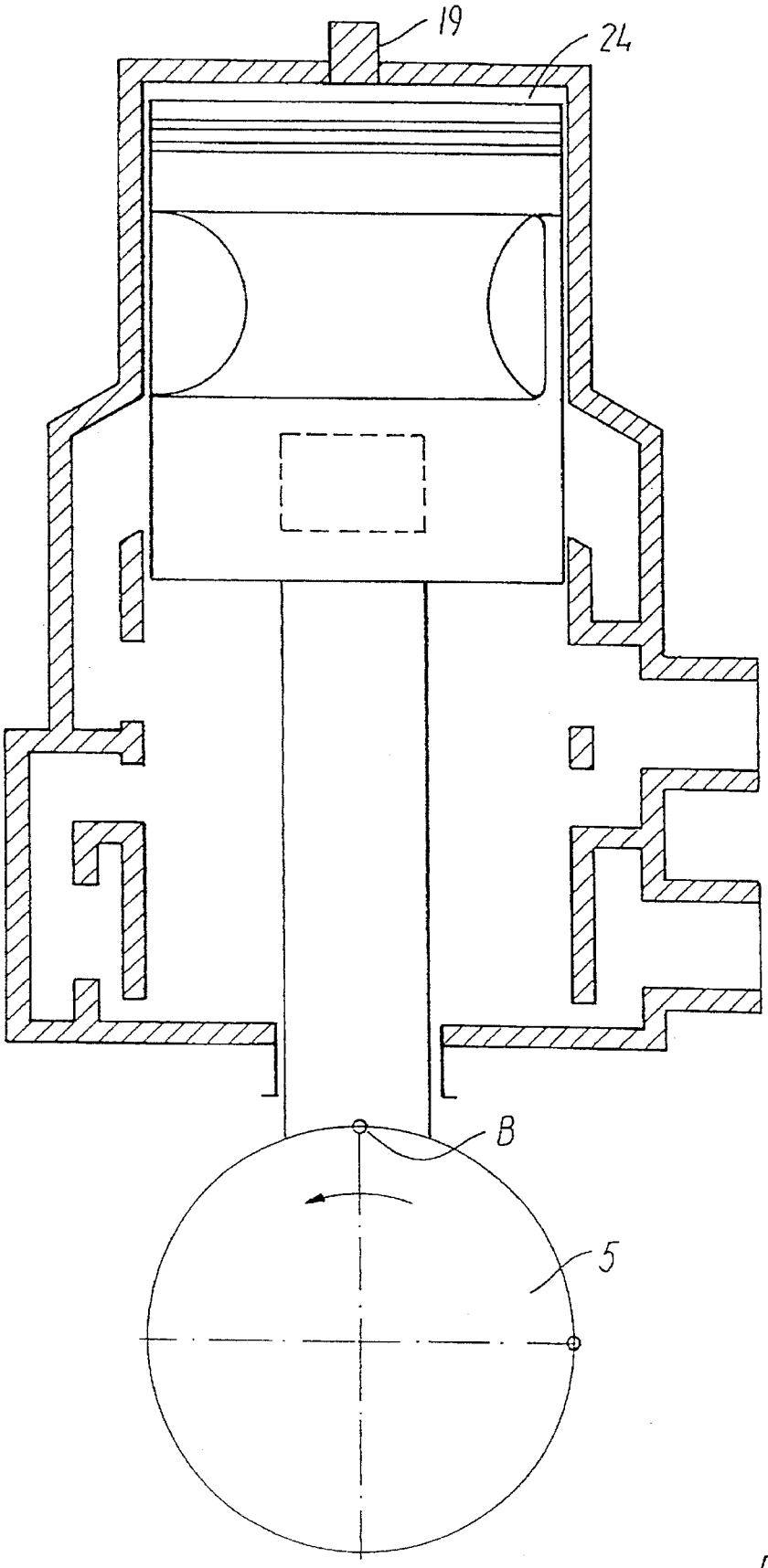
Figure 4:
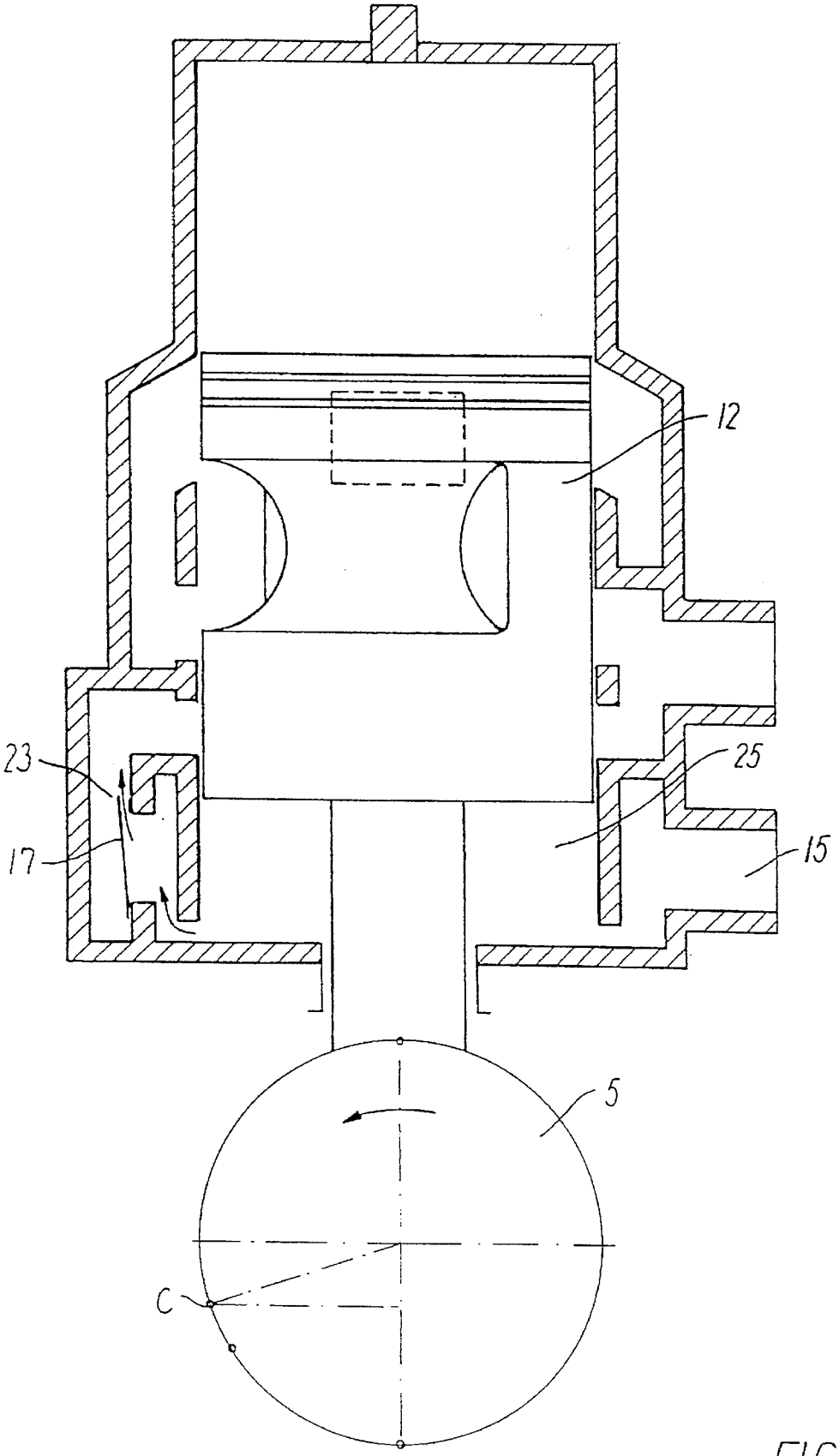
Figure 5:
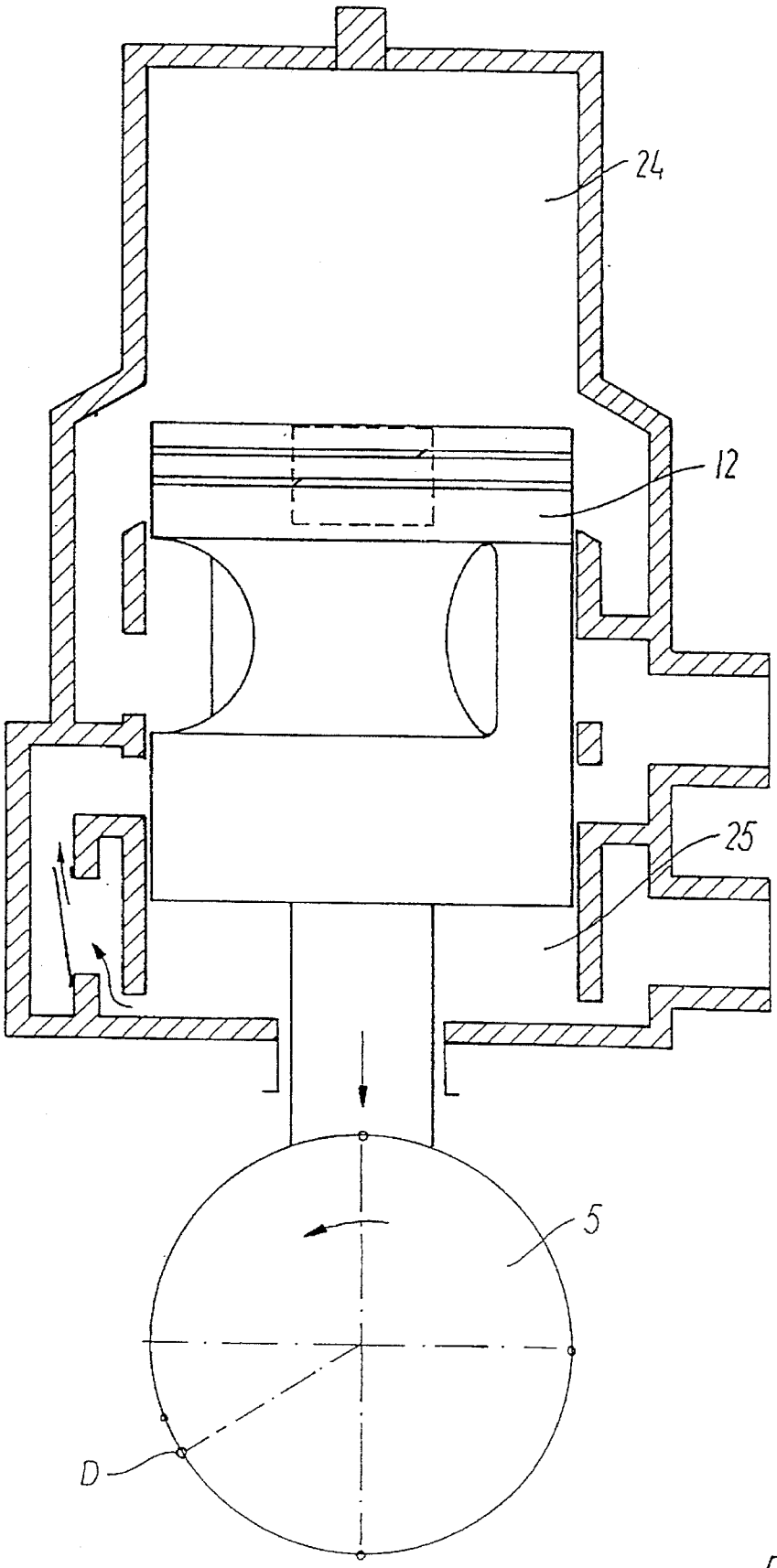
Figure 6:
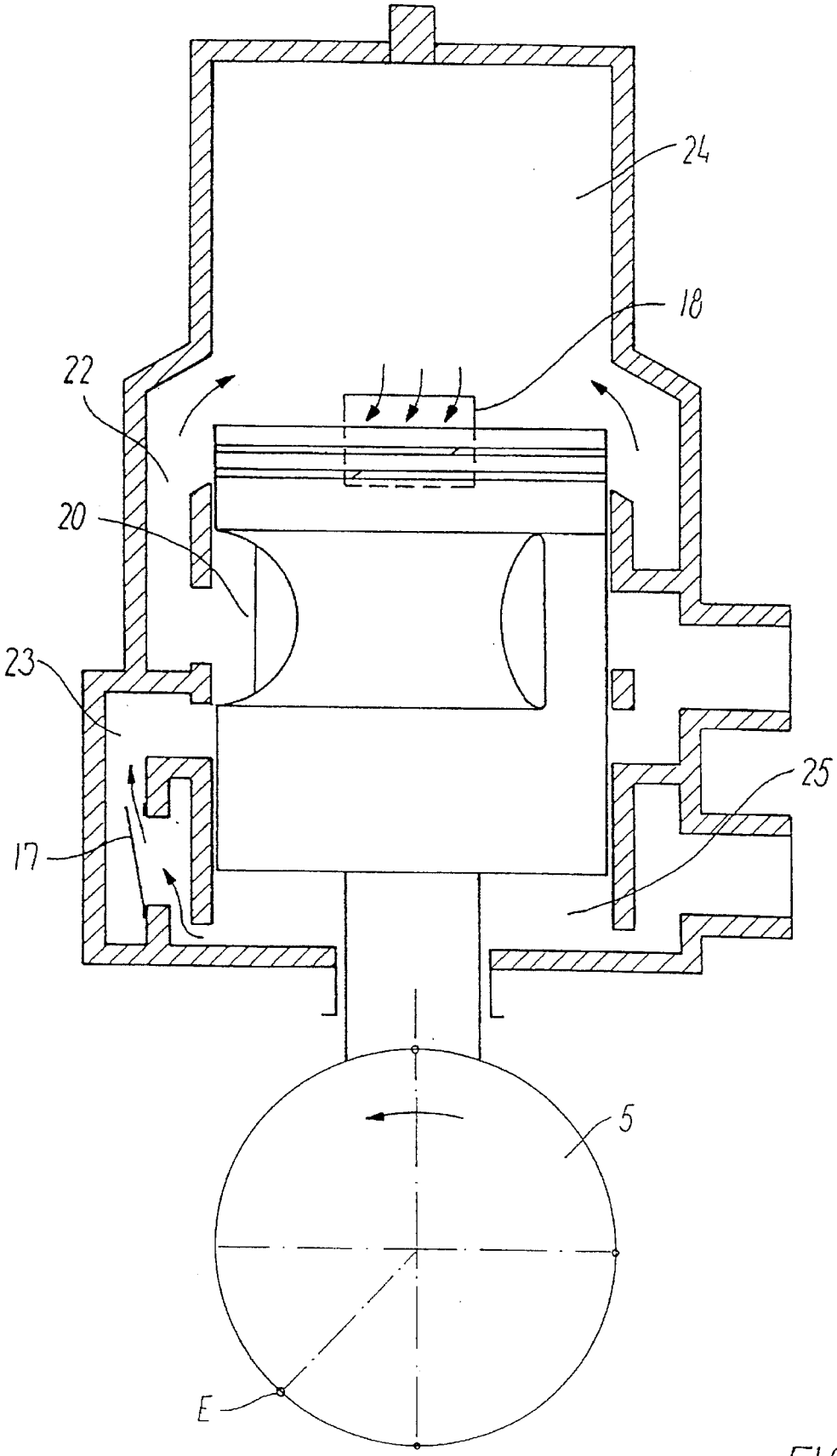
Figure 7:
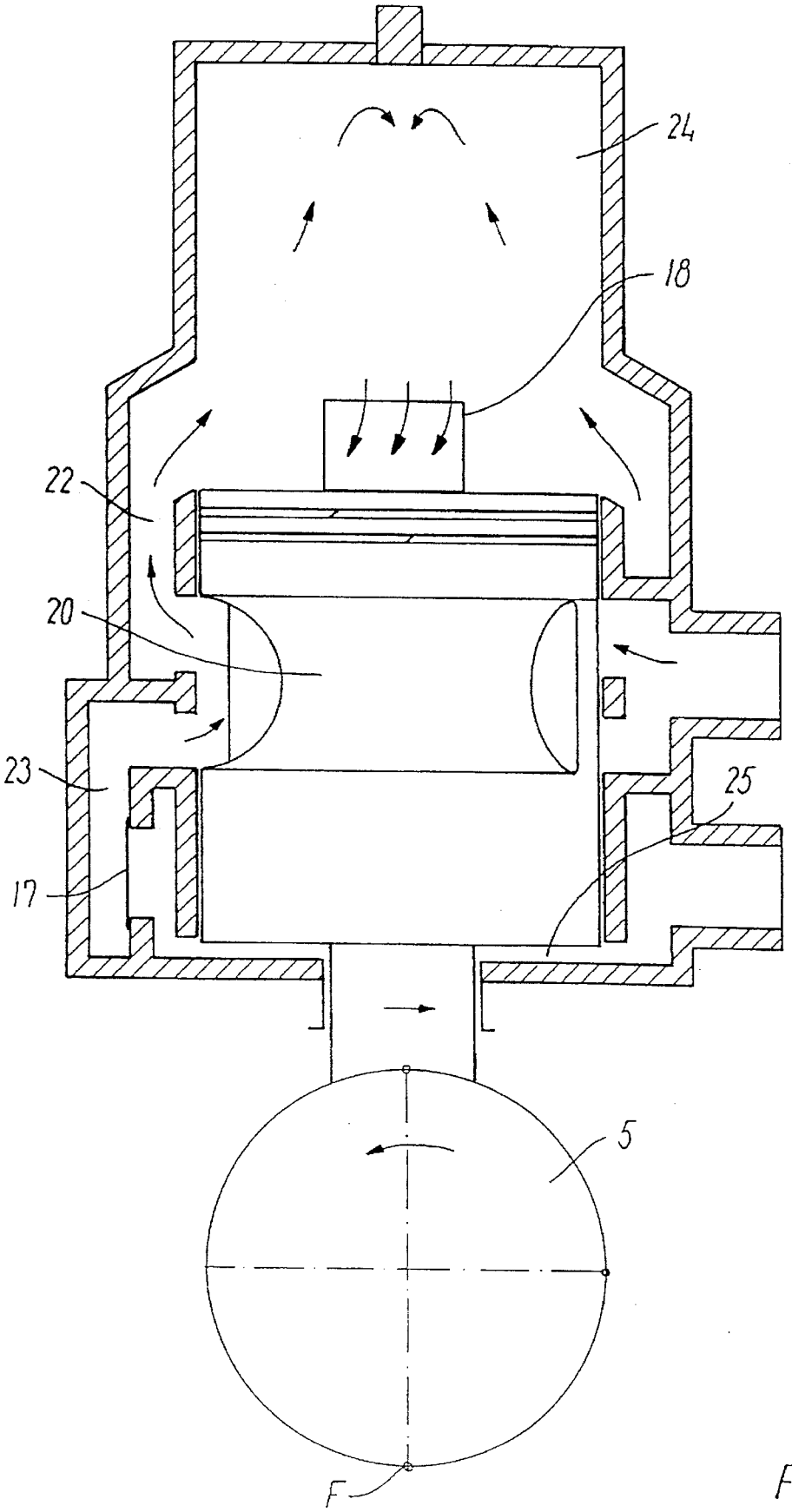
Figure 8:
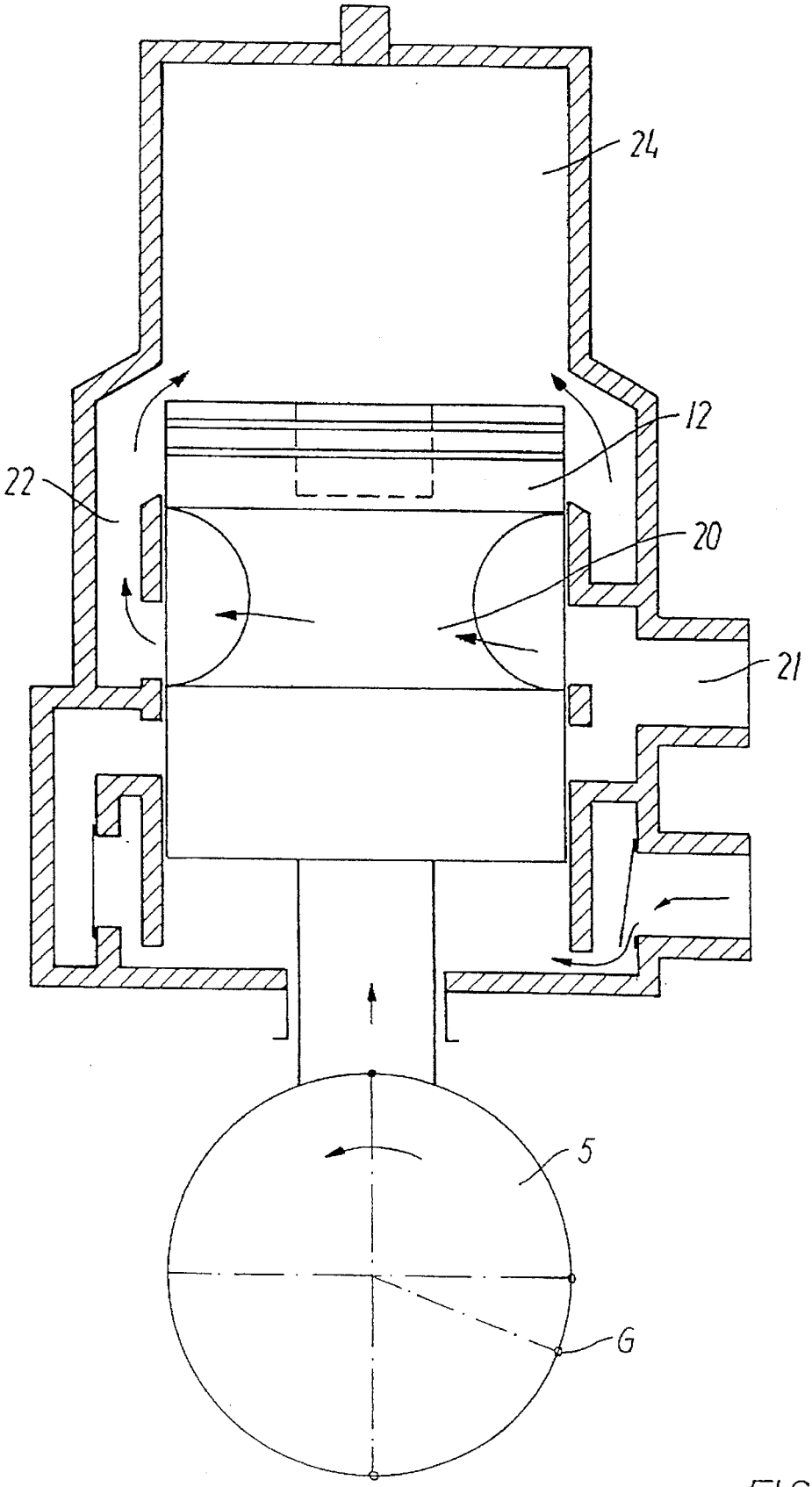
Figure 9:
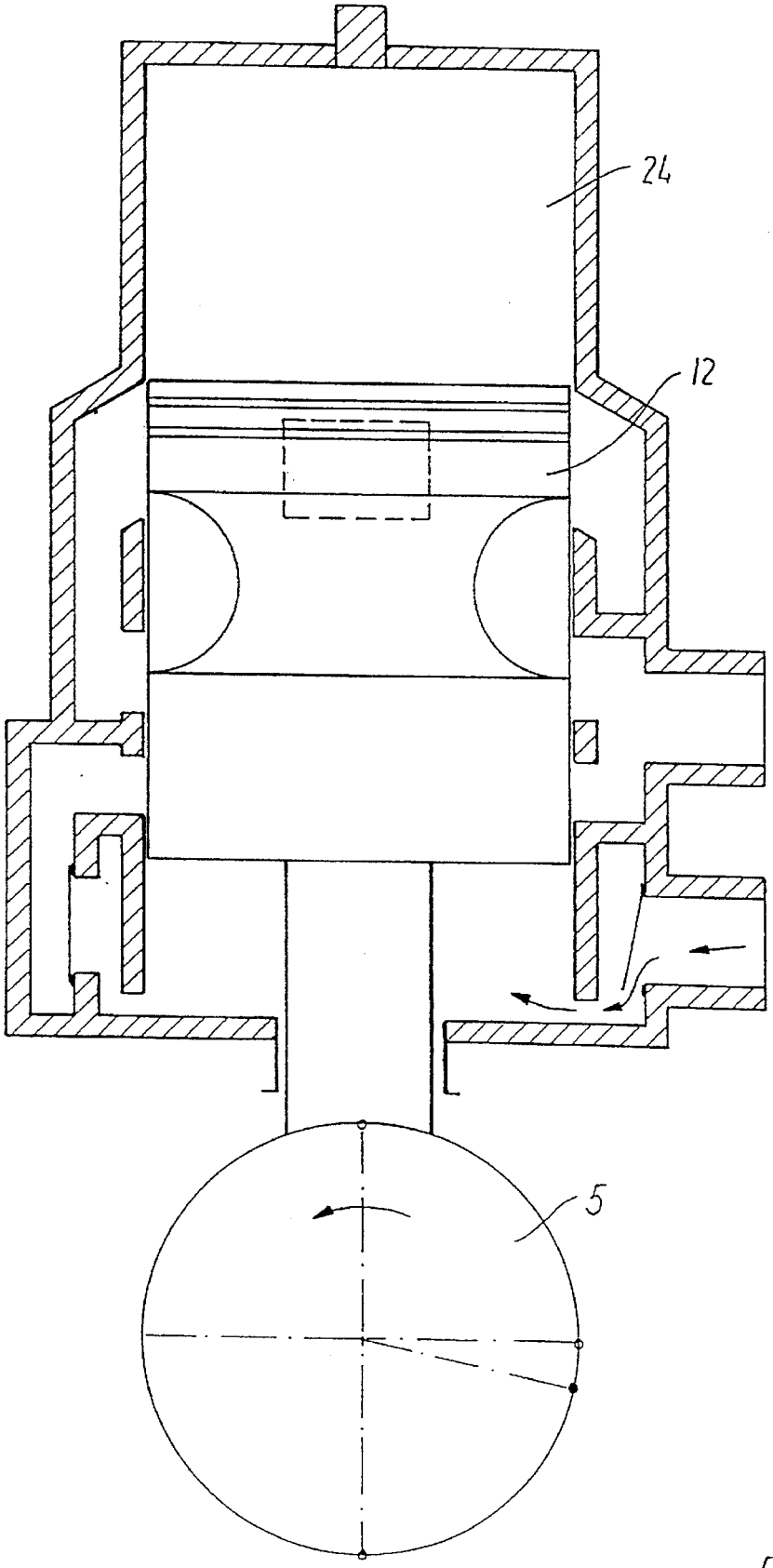
Figure 10:
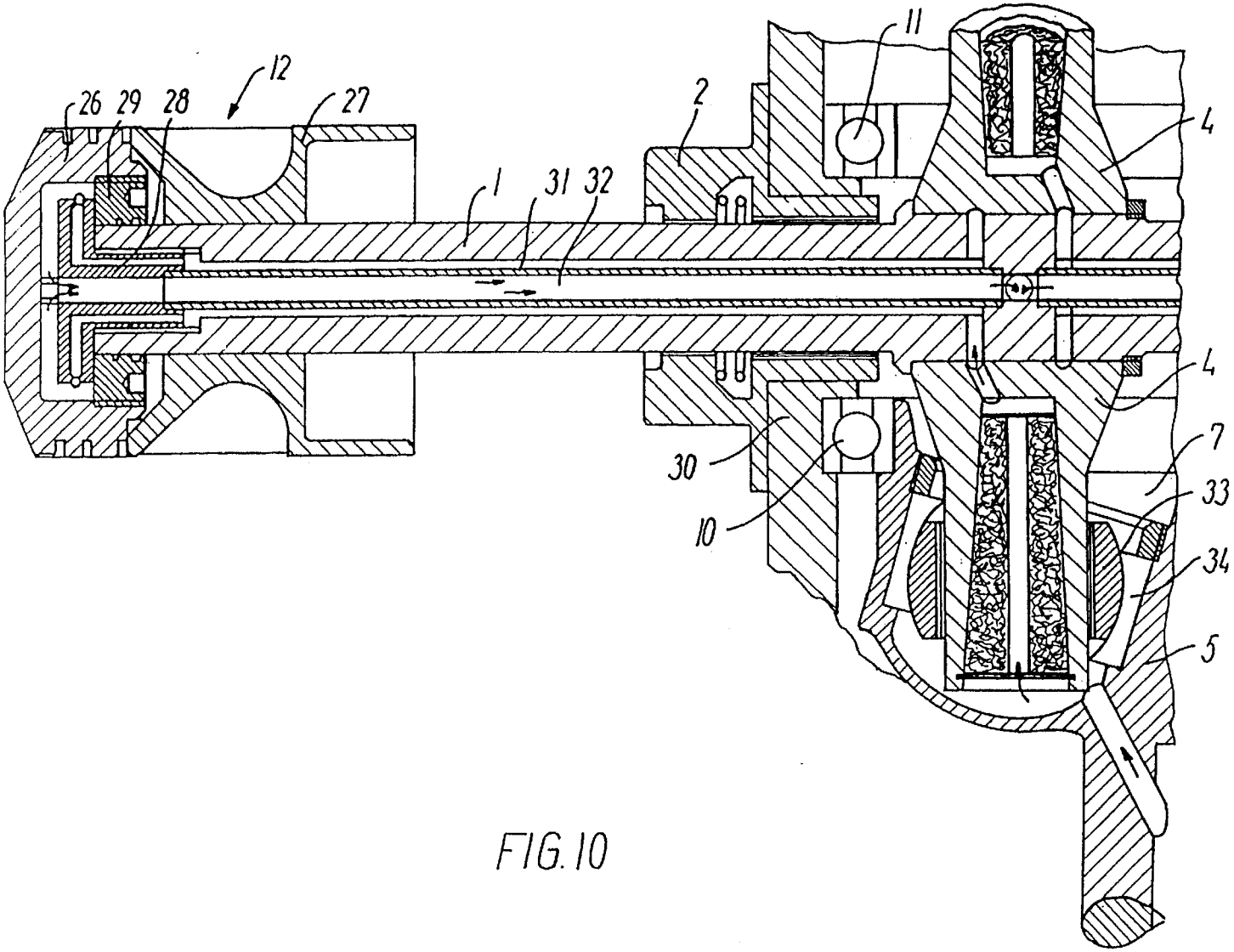
Figure 11:
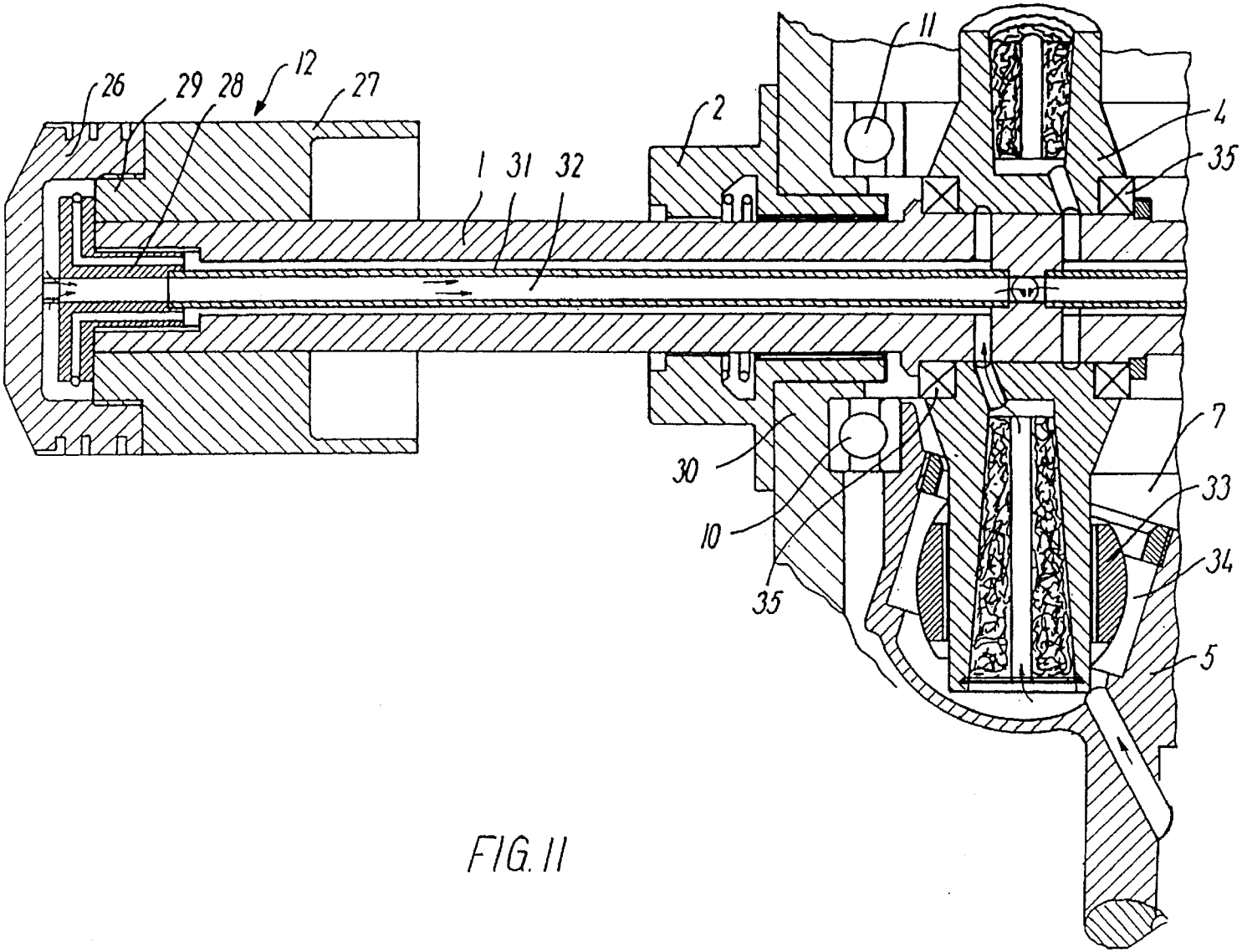

Embodiments of this invention will be described in greater detail below with reference to the accompanying drawings, in which FIG. 1 is an explanatory sketch of the driving mechanism for an engine of the known type, FIG. 2 is an explanatory sketch of a piston and a cylinder according to the invention in the compression phase, FIG. 3 is an explanatory sketch of the piston and the cylinder of FIG. 2 in the ignition phase, FIG. 4 is an explanatory sketch of the piston and the cylinder of FIG. 2 at the completion of the drive stroke, FIG. 5 is an explanatory sketch of the piston and the cylinder of FIG. 2 at the commencement of the exhaust phase, FIG. 6 is an explanatory sketch of the piston and the cylinder of FIG. 2 at the opening of the scavenging duct, FIG. 7 is an explanatory sketch of the piston and the cylinder of FIG. 2 at the completion of the pump stroke, FIG. 8 is an explanatory sketch of the piston and the cylinder of FIG. 2 at the commencement of the pressure charging, FIG. 9 is an explanatory sketch of the piston and the cylinder of FIG. 2 at the commencement of the compression stroke, FIG. 10 is a section of an assembly view of a drive mechanism for a combustion engine according to the invention, and FIG. 11 is a cross-sectional view of an alternative embodiment of a combustion engine according to the invention.

FIG. 1 shows the drive mechanism according to the known construction, which consists of a piston rod 1 capable of being rotated and displaced longitudinally through the piston bearings 2, 3. A connecting means 4 is firmly mounted at right angles to the piston rod 1. The two ends of the connecting means 4 are journalled in their respective rotors 5, 6 in connecting means bearings 7, 8 positioned offset from the axis of rotation of the rotors, as determined by the main bearings 10, 11. These main bearings 10, 11 are of a type ensuring that the connecting means 4 can just be rotated, turned and displaced in the bearing.

A piston 12, which is firmly mounted at one end of the piston rod 1, subjects the piston rod to a force in parallel with the axis of the piston rod because of the combustion pressure in a cylinder (not shown), which entails that the piston rod is displaced axially, and that the rotors 5, 6 are caused to rotate by the connection means 4.

When the rotors 5, 6 rotate, the piston rod is forcibly rotated about its axis owing to the mount 7, 8 of the connecting means in the rotors 5, 6, which in turn causes the piston 12 to rotate in the cylinder.

Consequently, this mechanism causes the piston 12 to follow a simultaneous translatory motion and a rotation about its axis. Assuming that the rotors rotate at a constant angular speed, the distribution of these two basic motions will be such that the translatory speed of the piston 12 will be greatest at the average stroke length of the piston 12 and zero at the dead-centers. On the other hand, the angular speed will be greatest at the dead-centers and zero at the average stroke length.

The effect of this hydrodynamic lubrication between the piston 12 and the cylinder wall will therefore be very poor about the dead-centers, which is fatal in connection with the great angular speed at these points, because this gives rise to unacceptably heavy wear on cylinder walls and piston rings.

Particularly at the top dead-center of the piston modern piston rings will be pressed outwardly against the cylinder wall because of the combustion pressure, which entails that extraordinarily huge wear will occur especially at the top dead-center.

The invention is contemplated for use i.a. in connection with two-stroke combustion engines where the forced angular rotation of the piston is utilized for controlling the inlet, scavenging and exhaust phases in a simple manner by providing the piston and cylinder walls with ducts, such that these are caused to assume various positions with respect to each other at the translation and rotation of the piston.

FIGS. 2–9, in a series of explanatory sketches, therefore show a complete working cycle for a two-stroke engine which is kinematically constructed according to the principle shown in FIG. 1.

FIG. 2 thus shows the compression phase in which the piston 12, because of the counterclockwise rotation of the rotor 5, compresses the fuel mixture in the compression chamber 24. The mount 7 of the connecting means 4 in the rotor 5 is present at point A in this phase.

FIG. 3 shows the subsequent ignition phase in which the sparking plug 19 ignites the fuel mixture in the combustion chamber 24. The mount 7 of the connection means 4 in the rotor is now present at point B.

Following the drive stroke in FIG. 4, it will be seen that the confined air in the space 25 behind the piston 12 is compressed, because the inlet valve, which is a one-way valve, prevents discharge of air through the scavenging air inlet duct 15. The scavenging air valve 17 hereby admits passage of scavenging air to the scavenging air duct 23, which, however, is still blocked at its outlet by the piston 12. The mount 7 of the connecting means 4 in the rotor 5 is now present at point C.

FIG. 5 shows a phase in which the scavenging air in the space 25 behind the piston 12 is compressed additionally, and where, because of the clearance of the piston 12 between the combustion chamber 24 and the scavenging and charging air duct 22, combustion gases are predischarged to the scavenging and charging air duct. The mount 7 of the connecting means 4 in the rotor 5 is now present at point D.

FIG. 6 shows a phase in which the scavenging air in the space 25 behind the piston 12 is pressed into the combustion chamber 24 under a high pressure via the scavenging air valve 17, the scavenging air duct 23, the piston scavenging duct 20 and the scavenging and charging air duct 22, thereby causing discharge of combustion gases from the combustion chamber 24 through the exhaust duct 18. The mount 7 of the connecting means 4 in the rotor 5 is now present at point E.

The discharge shown in FIG. 6 continues in FIG. 7, in which it will be seen, like in FIG. 6, that the piston scavenging duct 20 is angled such that it just allows said scavenging process. This angular rotation is a result of the fact that the mount 7 of the connecting means 4 in the rotor 5 is present at point F.

FIG. 8 shows the charging air phase, from which it will be seen that the rotation of the piston 12, because of the presence of the mount 7 of the connecting means in the rotor 5 at point G, permits supply of charging air via the charging air duct 21, the piston scavenging duct 20 and the scavenging and charging air duct 22 to the combustion chamber 24. This phase is completed as shown in FIG. 9, in which supply of charging air is closed, and a compression phase begins again.

FIG. 10 shows an embodiment of the invention in which the piston 12 is formed by a piston top 26 and a piston skirt 27. The piston skirt 27 is firmly mounted on the piston rod 1, and the piston top 26 is rotatably mounted on the piston rod 1, a screw-shaped element 28 being screwed into the end of the piston rod to engage a ring-shaped element 29 screwed into the piston top 26.

The piston rod 1 moves in controlled manner in the bearing 2 and is firmly connected with the connecting means 4, whose end is journalled in the connecting means bearing 7. This bearing is a roller bearing having an outer spherical ring 33 positioned in an inner spherical ring 34 mounted in the rotor 5. This entails that the connecting means 4 can be rotated, turned and displaced in its bearing. The rotor is mounted rotatably in the engine housing 30 by means of the main bearings 10, 11.

The piston top 26 is provided with an inner cavity having cooling faces which can be supplied with coolant, e.g. oil or water, via supply lines 31 and return lines 32. The supply lines 31 extend from the end of the connecting means 4 to the piston rod and within the piston rod upwardly to the top of the piston. The return lines extend from the top of the piston through the piston rod and terminate on the surface of the piston rod 1 in the engine housing 30. The return lines in the piston extend concentrically within the supply line.

FIG. 11 shows another embodiment of the invention, where the piston top 26 is firmly connected with the piston skirt, so that the piston top 26, the piston skirt 27 and the piston rod 1 move as one unit. In this embodiment of the invention a bearing connection 35 is provided between the piston rod 1 and the connection means 4, allowing the piston 26, the piston skirt 27 and the piston rod 1 to rotate as a whole about its axis.

In this construction, however, it will be necessary to provide special means for the scavenging processes, such as scavenging and exhaust valves in the cylinder top or other conventional scavenging means. Nethertheless, it enables the vibrationless kinematic structure to be used in connection with other piston engines based on different working principles, while reducing wear in the cylinder.

We claim:

1. An internal combustion engine having at least one cylinder and reciprocating means comprising pistons which are slidable in said cylinders, said reciprocating means and pistons having a common axis, a pair of rotors mounted on opposite sides of the axis of said reciprocating means to rotate about a common axis perpendicular to the axis of said reciprocating means in opposite directions and in counter phase, connecting means extending from opposite sides of said reciprocating means and engaging at least one of said rotors at a distance from their common axis, wherein a bearing connection is provided between at least a portion of the piston, which is in contact with the wall of the cylinder, and the connecting means, allowing the piston or at least a portion of the piston to be freely rotatable about its axis.

2. An engine according to claim 1, wherein the bearing connection is situated between at least a portion of the piston, which is in contact with the cylinder wall, and the piston rod.

3. An engine according to claim 1, wherein the bearing connection is situated between the piston rod and the connection means.

4. An engine according to claim 2, wherein the piston comprises two parts: a main body fastened to the piston rod and a piston top having grooves for rings mounted rotatably about its axis with respect to the main body.

5. A piston according to claim 4, wherein the piston top is mounted freely rotatably on the piston rod.

6. A piston according to claim 1, wherein the piston top comprises a cooling space inside the piston top having inlet and outlet openings to be connected with supply and return lines, respectively, in the piston rod for circulation of cooling liquid.

7. An engine according to claim 6, wherein the cooling liquid is water.

8. An engine according to claim 6, wherein the cooling liquid is oil.

9. An engine according to claim 6, wherein the supply lines in the piston rod are connected with further supply lines extending inside said connecting means and having an inlet opening at the end of the connecting means, away from the piston rod, and the return lines have an outlet opening situated on the piston rod near said connection means.

* * * * *